US011108192B2

(12) United States Patent
Tie et al.

(10) Patent No.: US 11,108,192 B2
(45) Date of Patent: Aug. 31, 2021

(54) BAYONET-TYPE BUNDLED RF CONNECTOR ASSEMBLY

(71) Applicant: CommScope Technologies LLC, Hickory, NC (US)

(72) Inventors: Lei Tie, Jiangsu (CN); Yujun Zhang, Jiangsu (CN); Jin Liu, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/916,480

(22) Filed: Jun. 30, 2020

(65) Prior Publication Data

US 2021/0013671 A1 Jan. 14, 2021

(30) Foreign Application Priority Data

Jul. 12, 2019 (CN) ..... 201910628431.5

(51) Int. Cl.
*H01R 13/62* (2006.01)
*H01R 13/625* (2006.01)
(Continued)

(52) U.S. Cl.
CPC ..... *H01R 13/625* (2013.01); *H01R 13/42* (2013.01); *H01R 13/621* (2013.01);
(Continued)

(58) Field of Classification Search
CPC ..... H01R 13/625; H01R 13/623
See application file for complete search history.

(56) References Cited

U.S. PATENT DOCUMENTS

2008/0254677 A1 10/2008 Amidon et al.
2014/0295690 A1 10/2014 Quero Pacheco et al.
(Continued)

FOREIGN PATENT DOCUMENTS

KR 101965807 B1 4/2019

OTHER PUBLICATIONS

International Search Report and Written Opinion corresponding to International Application No. PCT/US2020/040213 dated Oct. 21, 2020.

*Primary Examiner* — Ross N Gushi
(74) *Attorney, Agent, or Firm* — Myers Bigel, P.A.

(57) ABSTRACT

The present disclosure relates to a bayonet-type bundled RF connector assembly comprising: a male connector including a male connector body and a sleeve sleeved on the male connector body, wherein a first elastic member is provided in a gap between the male connector body and the sleeve, and the male connector body is provided with a plurality of first through holes; a plurality of unit male connectors for connecting a plurality of male connector cables, each unit male connector mounted in a respective first through hole; a plurality of second elastic members, each surrounding a respective one of the plurality of unit male connectors; and a female connector mated with the male connector, wherein the female connector includes a female connector body provided with a plurality of second through holes; and a plurality of unit female connectors for connecting a plurality of female connector cables, each of the unit female connectors mounted in a respective second through hole; wherein the sleeve of the male connector is connected to the female connector body of the female connector by a bayonet connection of a pin and a slot, and the first elastic member secures engagement between the pin and the slot, and each of the plurality of unit male connectors is urged into contact
(Continued)

with a respective one of the plurality of unit female connectors by a second elastic member.

20 Claims, 8 Drawing Sheets

(51) Int. Cl.

| | |
|---|---|
| ***H01R 13/623*** | (2006.01) |
| ***H01R 24/40*** | (2011.01) |
| ***H01R 13/621*** | (2006.01) |
| ***H01R 13/64*** | (2006.01) |
| ***H01R 13/42*** | (2006.01) |

(52) U.S. Cl.
CPC ..... *H01R 13/623* (2013.01); *H01R 13/64* (2013.01); *H01R 24/40* (2013.01)

(56) References Cited

U.S. PATENT DOCUMENTS

| | | | |
|---|---|---|---|
| 2017/0070003 | A1 | 3/2017 | An et al. |
| 2018/0034202 | A1 | 2/2018 | Pierce-Jones |

BAYONET-TYPE BUNDLED RF CONNECTOR ASSEMBLY

RELATED APPLICATION

The present application claims priority from and the benefit of Chinese Patent Application No. 201910628431.5, filed Jul. 12, 2019, the disclosure of which is hereby incorporated herein in its entirety.

FIELD OF THE INVENTION

The present disclosure generally relates to the field of cable connectors. More specifically, the present disclosure relates to a bayonet-type bundled RF connector assembly.

BACKGROUND OF THE INVENTION

The RF communication system typically uses a radio frequency connector to connect coaxial cables. Conventional RF connectors can only be connected to a single coaxial cable. With the development of miniaturization of communication devices, the arrangement of various components on the base station antenna has become more and more compact. Currently, bundled RF connectors have been developed to integrate multiple connection ports within a limited space to connect multiple coaxial cables.

Conventional bundled RF connectors generally employ a large threaded mechanism to connect a female connector and a male connector. It may take a long time for installation (requiring three to four or more turns), and special tools are required (such as torque wrenches).

SUMMARY OF THE INVENTION

One of the objects of the present disclosure is to provide a bundled RF connector assembly that is capable of overcoming at least one of the defects in the prior art.

The subject technology is illustrated according to various aspects described below. Various examples of accepts of the subject technology are described below. These are provided as examples and do not limit the subject technology.

As a first aspect, embodiments of the invention are directed to a bayonet-type bundled RF connector assembly, wherein the connector assembly comprises:

a male connector including a male connector body and a sleeve sleeved on the male connector body, wherein a first elastic member is provided in a gap between the male connector body and the sleeve, and the male connector body is provided with a plurality of first through holes;

a plurality of unit male connectors for connecting a plurality of male connector cables, each unit male connector mounted in a respective first through hole;

a plurality of second elastic members, each surrounding a respective one of the plurality of unit male connectors; and a female connector mated with the male connector, wherein the female connector includes a female connector body provided with a plurality of second through holes; and a plurality of unit female connectors for connecting a plurality of female connector cables, each of the unit female connectors mounted in a respective second through hole;

wherein the sleeve of the male connector is connected to the female connector body of the female connector by a bayonet connection of a pin and a slot, and the first elastic member secures engagement between the pin and the slot, and each of the plurality of unit male connectors is urged into contact with a respective one of the plurality of unit female connectors by a second elastic member.

In some embodiments, the male connector body includes a cylinder, and an outer flange that surrounds and projects radially outward from a sidewall of the cylinder.

In some embodiments, the sleeve includes a barrel, and an inner flange projecting radially inward from a proximal end surface of the barrel, wherein the inner flange abuts against the outer flange of the male connector body to secure the sleeve in place on the male connector body.

In some embodiments, the female connector body includes an intermediate wall portion, a proximal barrel portion projecting proximally from the intermediate wall portion, and a distal barrel portion projecting distally from the intermediate wall portion.

In some embodiments, the first elastic member is disposed on the cylinder of the male connector body between the proximal barrel portion of the female connector body and the outer flange of the male connector body.

In some embodiments, the first elastic member is a C-ring, a coil spring or any other element made from an elastic material.

In some embodiments, the unit male connector includes an outer contact connecting an outer conductor of a male connector cable, and a cable sleeve located radially outside the outer contact and fixed to an outer sheath of the male connector cable, the outer contact is provided with an outer flange at a portion exposed of the cable sleeve, and the second elastic member is disposed between the outer flange of the outer contact and an end of the cable sleeve.

In some embodiments, the unit female connector includes an outer contact for connecting the outer conductor of the female connector cable inside which a step portion is provided, and the outer contact of the unit male connector is insertable into the outer contact of the unit female connector and a distal end surface of the unit male connector is kept in contact with the step portion under an action of the second elastic member.

In some embodiments, the second elastic member is a C-ring, a coil spring or any other element made from an elastic material.

In some embodiments, an O-ring is provided between the inner flange of the sleeve and the outer flange of the male connector body.

In some embodiments, distal end portions of the plurality of male connector cables are connected to the plurality of respective unit male connectors, and a cable shield seals the plurality of male connector cables immediately adjacent to a proximal side of the male connector bodies.

In some embodiments, the connector assembly further includes a connector shield configured to enclose the assembled male and female connectors.

In some embodiments, the connector shield includes a proximal barrel portion having a smaller diameter, a distal barrel portion having a larger diameter and a shoulder that connects the proximal barrel portion and the distal barrel portion together.

In some embodiments, the proximal barrel portion of the connector shield includes an annular sidewall and a bottom wall that encloses a proximal opening of the annular sidewall, wherein the bottom wall and the annular sidewall jointly enclose a cable shield near the distal end portion of the cable.

In some embodiments, the distal barrel portion of the connector shield includes an annular sidewall and an inner flange that projects radially inwards from a distal end surface of the annular sidewall, wherein the inner flange of the connector shield abuts against an outer surface of the female connector body.

In some embodiments, the unit male connector is securable to a first through hole of the male connector by press fitting, welding or threaded engagement.

In some embodiments, the unit female connector is securable to a second through hole of the female connector by press fitting, welding or threaded engagement.

In some embodiments, the sleeve of the male connector and the female connector body of the female connector are provided with multiple pins and multiple spiral slots that are mated with each other.

In some embodiments, the bundled RF connector assembly is provided with a fool-proof mechanism in which a plurality of male connector cables and a plurality of female connector cables are connected one by one according to a predetermined solution.

In some embodiments, the fool-proof mechanism includes a plurality of bumps and a plurality of respective grooves, wherein the plurality of bumps and the plurality of grooves are circumferentially unevenly disposed on the sleeve of the male connector and the female connector body of the female connector respectively or circumferentially unevenly disposed on the female connector body of the female connector and the sleeve of the male connector respectively, and the circumferential positions of the plurality of bumps and the plurality of grooves are aligned one by one.

In some embodiments, the sleeve of the male connector and the female connector body of the female connector are respectively provided with markers configured to indicate that the circumferential positions of the plurality of bumps and the plurality of grooves are aligned one to one.

In some embodiments, the markers are small convex points, small concave points or patterns on the surfaces of the male connector and the female connector.

In some embodiments, the male connector body and the female connector body are integral pieces formed by metal forging or by plastic injection molding.

In some embodiments, at least a portion of the slot defines a portion of a spiral.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplifying and explanatory and are intended to provide further explanation of the subject technology as claimed.

BRIEF DESCRIPTION OF THE DRAWINGS

After reading the embodiments hereinafter in conjunction with the accompanying drawings, a plurality of aspects of the present invention will be better understood. In the accompanying drawings.

DETAILED DESCRIPTION

Figure 1:
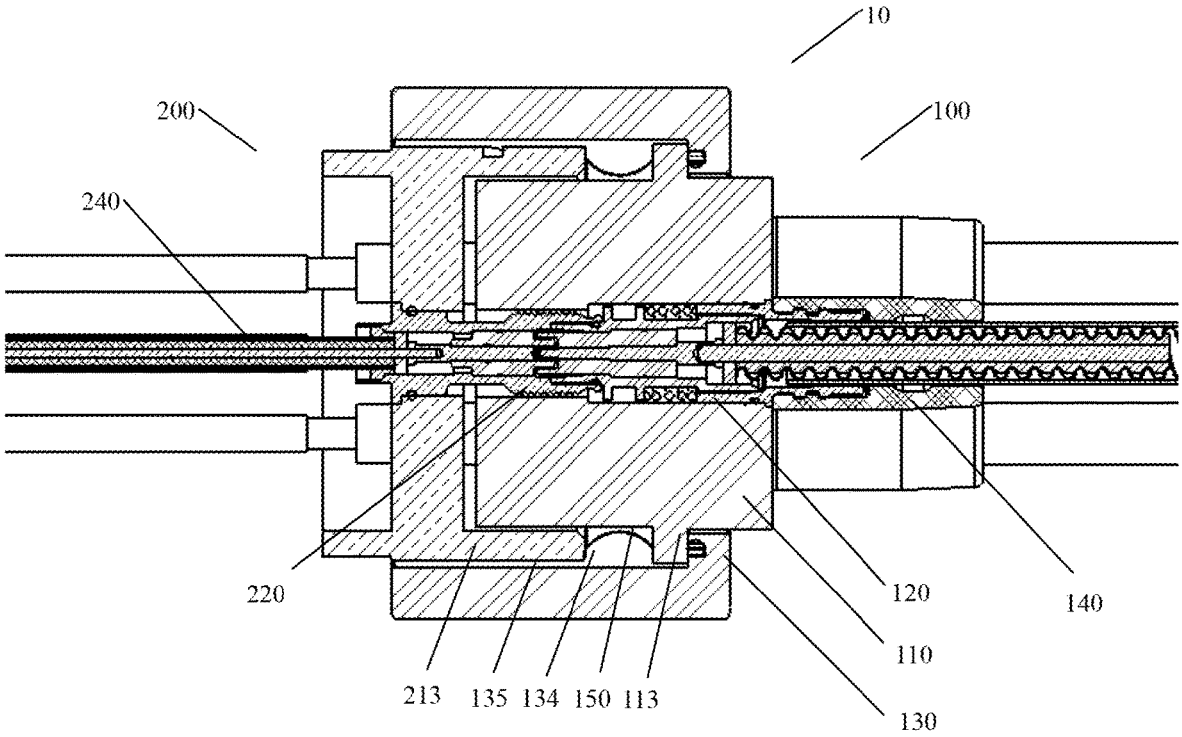
FIG. 1 is a cross-sectional view of a bayonet-type bundled RF connector assembly according to one embodiment of the present disclosure.

The present disclosure will be described below with reference to the drawings, in which several embodiments of the present disclosure are shown. It should be understood, however, that the present disclosure may be presented in multiple different ways, and not limited to the embodiments described below. In fact, the embodiments described hereinafter are intended to make a more complete disclosure of the present disclosure and to adequately explain the protection scope of the present disclosure to a person skilled in the art. It should also be understood that, the embodiments disclosed herein can be combined in various ways to provide more additional embodiments.

It should be understood that, in all the drawings, the same reference signs present the same elements. In the drawings, for the sake of clarity, the sizes of certain features may be deformed.

It should be understood that, the wording in the specification is only used for describing particular embodiments and is not intended to define the present disclosure. All the terms used in the specification (including the technical terms and scientific terms), have the meanings as normally understood by a person skilled in the art, unless otherwise defined. For the sake of conciseness and/or clarity, the well-known functions or constructions may not be described in detail any longer.

The singular forms "a/an", "said" and "the" as used in the specification, unless clearly indicated, all contain the plural forms. The wordings "comprising", "encompassing" and "containing" used in the specification indicate the presence of the claimed features, but do not repel the presence of one or more other features. The wording "and/or" as used in the specification includes any and all combinations of one or more of the relevant items listed. The phases "between X and Y" and "between about X and Y" as used in the specification should be construed as including X and Y. The phrase "between about X and Y" as used in the present specification means "between about X and about Y", and the phrase "from about X to Y" as used in the present specification means "from about X to about Y".

In the specification, when one element is referred to as being "on" another element, "attached to" another element, "connected to" another element, "coupled to" another element, or "in contact with" another element, the element may be directly located on another element, attached to another element, connected to another element, coupled to another element, or in contact with another element, or there may be present with an intermediate element. By contrast, where one element is referred to as being "directly" on another element, "directly attached to" another element, "directly connected to" another element, "directly coupled to" another element, or "in direct contact with" another element, there will not be present with an intermediate element. In the specification, where one feature is arranged to be "adjacent" to another feature, it may mean that one feature has a portion that overlaps with an adjacent feature or a portion that is located above or below an adjacent feature.

In the specification, the spatial relation wordings such as "up", "down", "left", "right", "forth", "back", "high", "low" and the like may describe a relation of one feature with another feature in the drawings. It should be understood that, the spatial relation wordings also contain different orientations of the apparatus in use or operation, in addition to containing the orientations shown in the drawings. For example, when the apparatus in the drawings is overturned, the features previously described as "below" other features may be described to be "above" other features at this time. The apparatus may also be otherwisely oriented (rotated 90 degrees or at other orientations). At this time, the relative spatial relations will be explained correspondingly.

In the specification, one side closer to the male connector when the male connector and the female connector are mated is defined as a proximal side, and one side closer to the female connector is defined as a distal side.

Bayonet connection is often used in quick fit and detachment arrangements. In the field of RF connectors, the bayonet connection is generally referred to as a BNC, BNT, SHV or MHV interface. The present application uses the bayonet connection to achieve an outdoor connector having a multi-port and miniaturized RF connector interface, thereby adapting to the development demands of 5G communication technology and the like.

A bayonet-type bundled RF connector assembly according to one embodiment of the present disclosure, which is generally indicated by the reference sign 10, will now be described with reference to FIGS. 1-13. As shown in FIG. 1, the bayonet-type bundled RF connector assembly 10 includes a male connector 100 and a female connector 200 that are mated with each other. The male connector 100 is integrated with a plurality of unit male connectors 120 for connecting a plurality of respective cables 140, while the female connector 200 is integrated with a plurality of unit female connectors 220 for connecting a plurality of respective cables 240. The number of the unit male connectors 120 is the same as that of the unit female connectors 220, so that both of them can be in one-to-one correspondence when mated.

Figure 2:
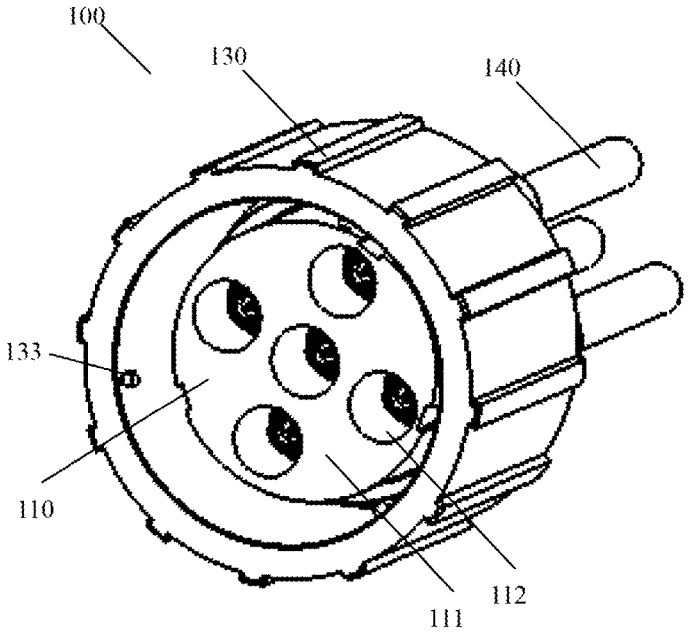
FIGS. 2-4 are respectively an assembled perspective view, an exploded perspective view, and a cross-sectional view of a male connector of the bayonet-type bundled RF connector assembly shown in FIG. 1.
Figure 3:
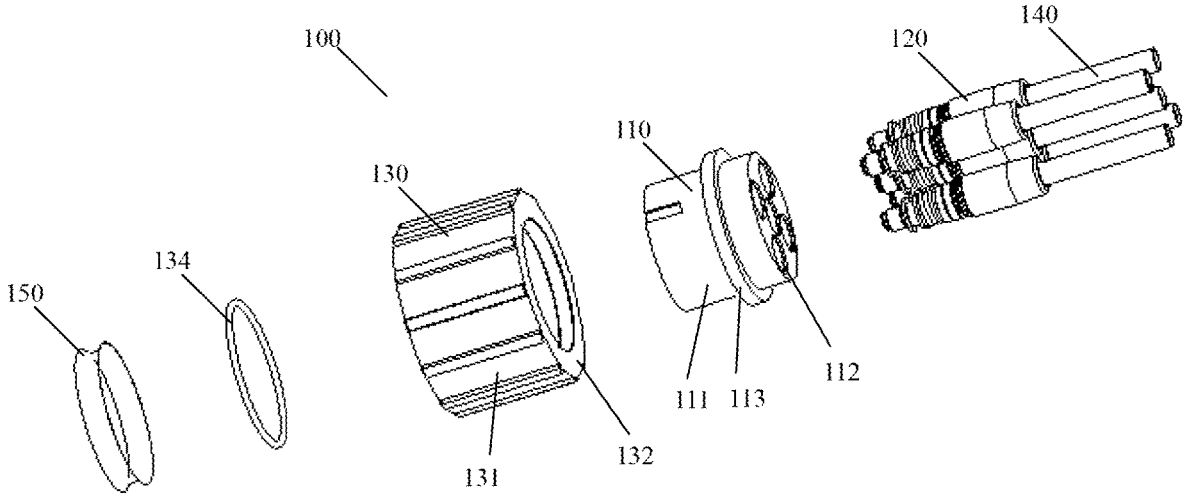
Figure 4:
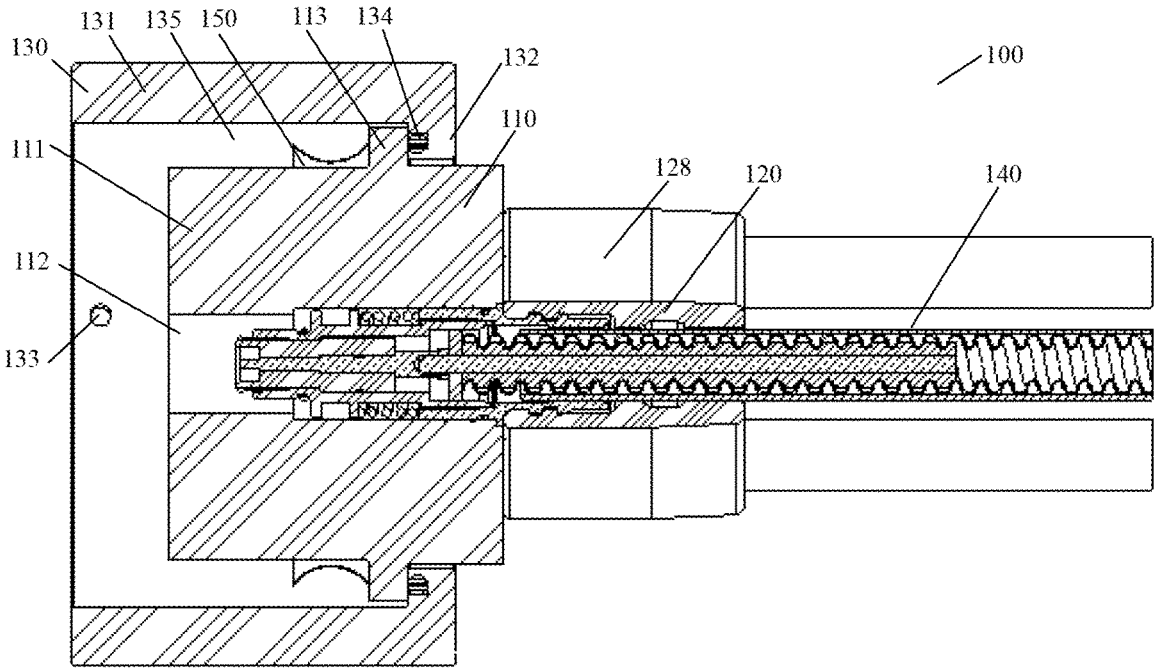

FIGS. 2-4 show an assembled perspective view, an exploded perspective view, and a cross-sectional view of a male connector 100 of the bayonet-type bundled RF connector assembly 10. As shown in FIGS. 2-4, the male connector 100 includes a male connector body 110 and a sleeve 130 that is sleeved on the male connector body 110. The male connector body 110 accommodates a plurality of unit male connectors 120, while the sleeve 130 is used to connect the male connector 100 to the female connector 200.

The male connector body 110 has a substantially cylindrical shape. The male connector body 110 includes a plurality of through holes 112 that penetrate through distal and proximal end surfaces of the cylinders 111, so as to receive a plurality of respective unit male connectors 120. The central axes of the plurality of through holes 112 are parallel to each other, and perpendicular to the distal and proximal end surfaces of the cylinders 111. The plurality of through holes 112 may be arranged in the male connector body 110 in multiple manners. In the embodiments shown in FIGS. 2-4, the male connector body 110 is provided with five through holes 112 arranged in a cruciform pattern, wherein the central axes of the four through holes 112 are evenly distributed on one circle, and the central axis of the other through hole 112 is arranged on the center of the circle. Other numbers of through holes 112 (for example, three, four, or six, or more) may be also provided in the male connector body 110 according to actual needs, and/or the plurality of through holes 112 may be arranged in other patterns (for example, the central axes of the plurality of through holes may be arranged in a circle, and the like). The male connector body 110 also includes an outer flange 113 that surrounds the sidewall of the cylinder 111 and projects radially outward from the sidewall to securing the sleeve 130 in place on the cylinder 111. The outer flange 113 is located between the distal and proximal end surfaces of the cylinder 111, and closer to the proximal end surface of the cylinder 111 with respect to the distal end surface of the cylinder 111.

The sleeve 130 has a substantially cylindrical shape. The sleeve 130 includes a barrel 131 and an inner flange 132 that projects radially inward from a proximal end surface of the barrel 131. The barrel 131 includes a pin 133 located on its inner surface for connecting the male connector 100 to the female connector 200. The inner diameter of the cylinder 131 is slightly larger than the outer diameter of the outer flange 113 of the male connector body 110; the inner diameter of the inner flange 132 is smaller than the outer diameter of the outer flange 113 of the male connector body 110, but larger than the outer diameter of the cylinder 111 of the male connector body 110. Thus, the inner flange 132 of the sleeve 130 can abut against the outer flange 113 of the male connector body 110, thereby securing the sleeve 130 in place on the male connector body 110 and leaving an annular gap 135 for receiving the female connector 200 therebetween. An O-ring 134 for sealing is provided between the inner flange 132 of the sleeve 130 and the outer flange 113 of the male connector body 110 to prevent infiltration or entry of liquid or foreign matter into the interior of the male connector 100.

Figure 5:
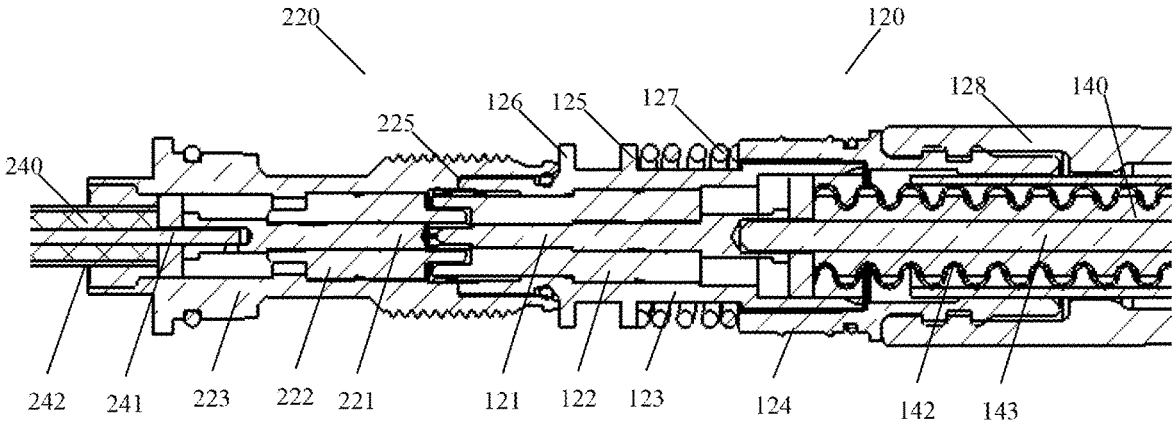
FIG. 5 is a cross-sectional view of a single unit male connector and a single unit female connector shown in FIG. 1.

The unit male connector 120 is used to connect the cable 140 to the male connector body 110. Referring to FIG. 5, the unit male connector 120 includes an inner contact 121, a dielectric spacer 122, an outer contact 123, and a unit male connector housing 124 from the inside to the outside. The inner contact 121 has a cylindrical shape, and has a distal end portion that is inserted into the unit female connector 220 and a proximal end portion that receives the inner conductor 143 of the cable 140. The outer contact 123 has a cylindrical shape with its proximal end portion abutting against the outer conductor 142 of the coaxial cable 140 and distal end portion axially abutting against the unit female connector 220. The dielectric spacer 122 is annular, and positioned between the inner contact 121 and the outer contact 123 to dielectrically isolate the inner contact 121 and the outer contact 123. The unit male connector housing 124 is connected to the distal end portion of the cable 140, and secured within the through hole 112 of the male connector body 110.

A portion of the outer contact 123 exposed out of the unit male connector housing 124 is provided with two outer flanges 125 and 126 surrounding the outer surface thereof and projecting radially outward from the outer surface thereof. The two outer flanges 125 and 126 are axially spaced apart. An elastic member 127 is provided between the unit male connector housing 124 and the outer flange 125, and one end of the elastic member 127 abuts against the distal end surface of the unit male connector housing 124, while the other end abuts against the proximal end surface of the outer flange 125. The elastic member 127 remains in a pre-compressed state, thereby urging the outer flange 125 and the distal end surface of the outer contact 123 axially against the step portion 225 of the unit female connector 220 to ensure that the male connector unit 120 and the cable 140 can remain in mechanical connection and electrical connection to the unit female connector 220 and the cable 240 during vibration (e.g., vibration caused by earthquake, handling and the like) to prevent any loosening therebetween, so as to ensure the PIM performance of the connector assembly. The elastic member 127 may be a coil spring, a C-ring, or any other member made from an elastic material. The outer flange 126 is used to abut against the distal end surface of the female connector 200. In some embodiments, a cable shield 128 for sealing is also provided on the unit male connector housing 124 and the exposed cable segment.

The unit male connector 120 may be arranged in the through hole 112 of the cylinder 111 of the male connector body 110 in various manners. In one embodiment according to the present disclosure, each unit male connector 120 is press fit onto the inner surface of the through hole 112 by small barbs on the unit male connector housing 124. The unit male connector 120 may be arranged in the through hole 112 of the male connector body 110 in other manners. For example, the unit male connector 120 may be arranged in the through hole 112 of the male connector body 110 by techniques such as threaded connection or welding.

In one embodiment, as shown in FIG. 4, portions of the plurality of cables 140 proximate to the distal end portion thereof are connected together by a cable shield 128. Each cable 140 passes distally through a through hole in the cable shield 128, and is connected to the unit male connector 120, and secured to the through hole 112 of the male connector body 110 by the unit male connector 120. When the plurality of cables 140 are connected to the male connector body 110, the cable shield 128 prevents infiltration or entry of liquid or other foreign matter into the interior of the male connector 100.

Figure 6:
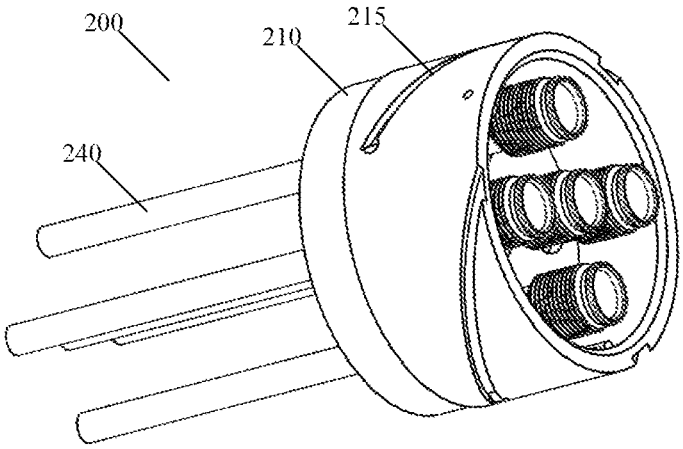
FIGS. 6-8 are an assembled perspective view, an exploded perspective view, and a cross-sectional view of a female connector of the bayonet-type bundled RF connector assembly shown in FIG. 1.
Figure 7:
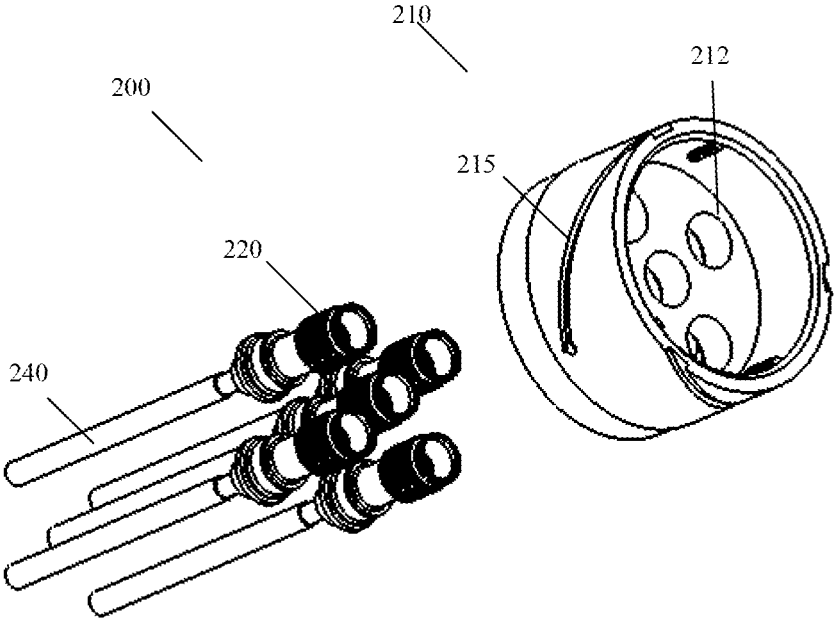
Figure 8:
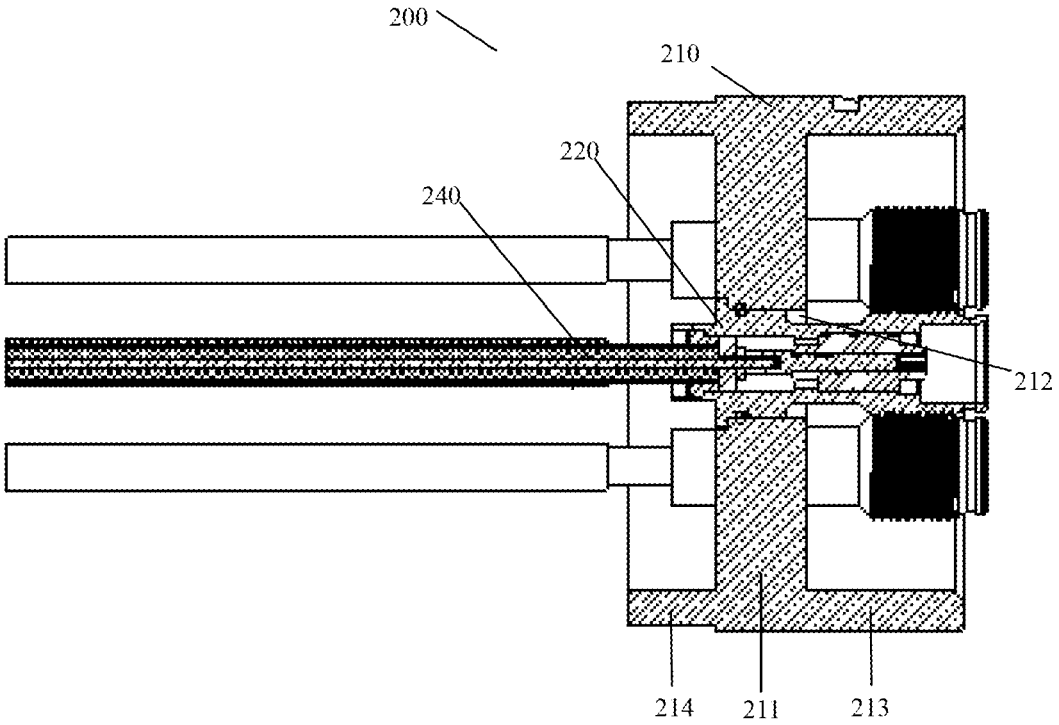

Referring next to FIGS. 6-8, the female connector 200 includes a female connector body 210 for accommodating a plurality of unit female connectors 220. The number and arrangement manner of the unit female connectors 220 of the female connector 200 correspond to those of the unit male connectors 120 of the male connector 100 so that both of them can be in one-to-one correspondence when mated.

The female connector body 210 has a substantially cylindrical shape. The female connector body 210 includes an intermediate wall portion 211 that is perpendicular to a central axis of the cylindrical body, and a proximal barrel portion 213 that projects proximally from a circumference of the intermediate wall portion 211 parallel to the central axis of the cylindrical body and a distal barrel portion 214 projecting distally. The intermediate wall portion 211 includes a plurality of through holes 212 penetrating through distal and proximal end surfaces thereof for receiving a plurality of respective unit female connectors 220. The number and arrangement manner of the through holes 212 correspond to those of the through holes 112 of the male connector 100.

The proximal barrel portion 213 is disposed proximal of the intermediate wall portion 211, and used to connect the female connector 200 to the male connector 100. The inner diameter of the proximal barrel portion 213 is slightly larger than the outer diameter of the cylindrical body 111 of the male connector body 110 of the male connector 100. The outer diameter of the proximal barrel portion 213 is equivalent to the inner diameter of the barrel 131 of the sleeve 130 of the male connector 100, and the outer surface of the proximal barrel portion 213 is provided with a spiral slot 215 for engaging the pin 133 of the sleeve 130 of the male connector 100. When the pin 133 of the sleeve 130 of the male connector 100 is positioned in, then screwed into the spiral slot 215 of the proximal barrel portion 213, the annular wall portion of the proximal barrel portion 213 enters the annular gap 135 between the sleeve 130 and the male connector body 110.

The distal barrel portion 214 is disposed distal of the intermediate wall portion 211, and used to abut against the connector shield 300 (described in detail hereinafter), so as to sealingly fit the male connector 100 and the female connector 200 together. In one embodiment, the distal barrel portion 214 has substantially the same outer diameter as the proximal barrel portion 213.

The unit female connector 220 is used to connect the cable 240 to the female connector body 210. As shown in FIG. 5, the unit female connector 220 includes an inner contact 221, a dielectric spacer 222, and an outer contact 223 from the inside to the outside. The inner contact 221 has a cylindrical shape, and has a proximal end portion receiving a distal end portion of the inner contact 121 of the unit male connector 120, and a distal end portion receiving the inner conductor 241 of the cable 240. The outer contact 223 has a cylindrical shape with a proximal end for receiving a distal end portion of the unit male connector 120 and a distal end portion abutting against the outer conductor 242 of the cable 240. The proximal portion of the inner cavity of the outer contact 223 is provided with a step portion 225, and used to abut against the distal end portion of the outer contact 123 of the unit male connector 120. Under the effect of the elastic member 127 of the unit male connector 120, the distal end portion of the outer contact 123 of the unit male connector 120 is firmly in contact with the step portion 225 of the outer contact 223 of the unit female connector 220, to prevent loosening or even detachment between the unit male connector 120 and the unit female connector 220 during vibration. The dielectric spacer 222 is annular, and positioned between the inner contact 221 and the outer contact 223 for dielectrically isolating the inner contact 221 and the outer contact 223.

The unit female connectors 220 may be arranged in the through holes 212 of the transverse wall portion 211 of the female connector body 210 in various manners. In the embodiment according to the present disclosure, each unit female connector 220 may be press fit to the through hole 212 of the transverse wall portion 211. Each unit female connector 220 may also be fixed to the through hole 212 of the transverse wall portion 211 by threaded connection, welding or the like.

In one embodiment, as in FIGS. 1 and 3-4, the male connector 100 further includes an elastic member 150 disposed within the annular gap 135 between the sleeve 130 and the male connector body 110. The proximal barrel portion 213 of the female connector 200 is screwed into the annular gap 135 by engagement with the sleeve 130 of the male connector 100, and compresses the elastic member 150 against the outer flange 113 of the male connector body 110. The elastic member 150 can generate a distally reacting force to the proximal barrel portion 213, for strengthening the connection between the proximal barrel portion 213 and the sleeve 130 and preventing loosening or detachment between the male connector 100 and the female connector 200 during vibration. In the example shown in FIG. 1, the elastic member 150 is a C-ring made from an elastic material; in other examples, the elastic member 150 may also be any other form of element made from an elastic material, such as a corrugated ring, a coil spring or the like. The elastic members 127 and 150 are mated with each other during vibration for preventing any loosening in mechanical connection and electrical connection between the male connector 100 and the female connector 200, so as to ensure the PIM performance of the connector assembly.

In one embodiment, the pins 133 of the sleeve 130 of the male connector 100 and the helical slots 215 of the proximal barrel portion 213 of the female connector 200 may be a plurality of pins and multiple spiral slots that are mated with each other. The multiple spiral slots may be 3 spiral slots or 4 spiral slots. The use of multiple slots may save the mating time of the male connector 100 and the female connector 200, thereby achieving a quick mating therebetween.

Figure 9:
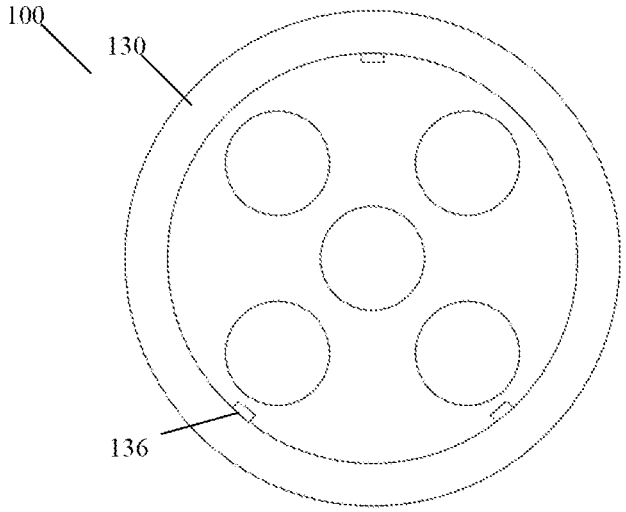
FIGS. 9 and 10 are fool-proof mechanisms on the male connector and the female connector of the bayonet-type bundled RF connector assembly shown in FIG. 1.
Figure 10:
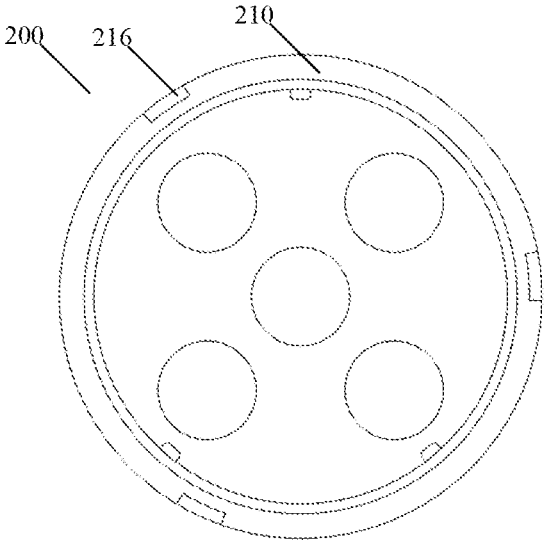

In one embodiment, the male connector 100 and the female connector 200 are provided with a "fool-proof" mechanism to ensure that the male connector 100 and the female connector 200 are connected together according to predetermined angular positions. As shown in FIG. 9, a plurality of (for example, three, five, etc.) bumps 136 unevenly distributed along a circumferential direction are provided on the inner surface of the sleeve 130 of the male connector 100, a plurality of respective grooves 216 unevenly distributed along a circumferential direction are provided on an outer surface of the proximal barrel portion 213 of the female connector body 210 of the female connector 200, and the positions of the bumps 136 and the grooves 215 along a circumferential direction are in one-to-one correspondence. Since the bumps 136 and the grooves 215 are unevenly distributed along a circumferential direction, it is only when the sleeve 130 of the male connector 100 and the proximal barrel portion 213 of the female connector 200 are aligned according to predetermined angular positions, that the proximal barrel portion 213 of the female connector 200 can be inserted into and rotated inside the sleeve 130 of the male connector 100, so as to ensure that the plurality of cables 140 of the male connector 100 and the plurality of cables 240 of the female connector 200 after connection are connected one by one in a predetermined way. In an alternative embodiment, the bumps may also be disposed on the outer surface of the proximal barrel portion 213 of the female connector body 210, while the grooves are disposed on the inner surface of the sleeve 130 of the male connector 100. In one embodiment, markers are respectively provided on the sleeve 130 of the male connector 100 and the female connector body 210 of the female connector 200 for visual indication during alignment. The markers may be small convex points, small concave points, patterns and the like on the surfaces (e.g., bump and groove surfaces) of the male and female connector surfaces.

Figure 11:
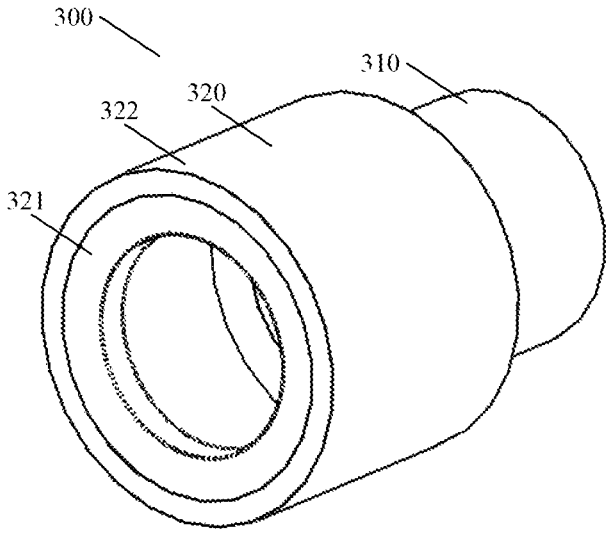
FIGS. 11 and 12 are perspective views of a shield for the bayonet-type bundled RF connector assembly shown in FIG. 1.
Figure 12:
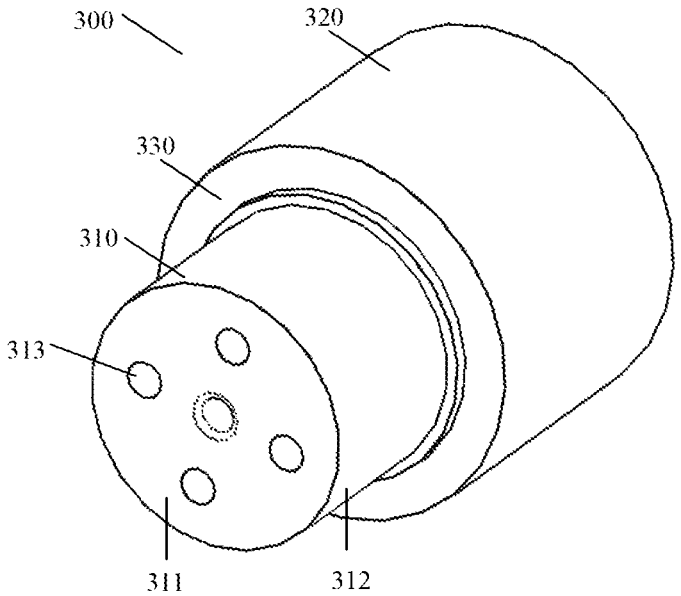
Figure 13:
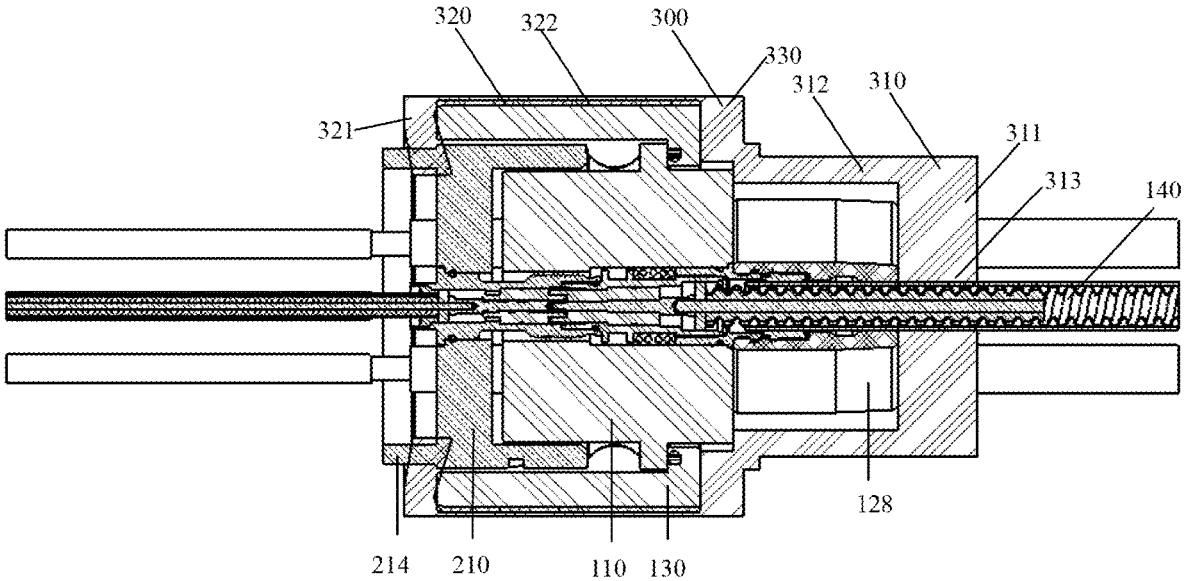
FIG. 13 is a cross-sectional view of the bayonet-type bundled RF connector assembly shown in FIG. 1 mounted with a shield.

In one embodiment, as shown in FIGS. 11-13, the bayonet-type bundled RF connector assembly 10 may also comprise a connector shield 300 for protecting and sealing the assembled male connector 100 and the female connector 200 against the influence of the external environment. The connector shield 300 is generally cylindrical in shape, and includes a proximal barrel portion 310 and a distal barrel portion 320 that are connected to each other. The outer diameter of the proximal barrel portion 310 is smaller than the outer diameter of the distal barrel portion 320, and both of them are connected together by the shoulder 330.

The proximal barrel portion 310 of the connector shield 300 includes an annular sidewall 312 that surrounds and is parallel to the central axis of the barrel portion 310, and a bottom wall 311 perpendicular to the central axis of the barrel portion 310 and enclosing the proximal opening of the annular sidewall 312. The bottom wall 311 is used to protect and seal the proximal portion of the assembled male connector 100 and female connector 200, and is provided with a plurality of through holes 313 for passage of the cable 140. The bottom wall 311 and the annular sidewall 312 of the proximal barrel portion 310 jointly enclose the cable shield 128 of the cable 140.

The distal barrel portion 320 of the connector shield 300 includes an annular sidewall 322 that surrounds and is parallel to the central axis of the barrel portion 320, and an inner flange 321 that projects radially inward from the distal end surface of the annular sidewall 322. The annular sidewall 322 encloses the mutually mated portions of the male connector 100 and the female connector 200, which includes the exposed portions of the male connector body 110, the sleeve 130, and the female connector body 210. The inner flange 321 abuts against the outer surface of the distal barrel portion 214 of the female connector body 210 to protect and seal the distal end portion of the assembled male connector 100 and female connector 200.

The connector shield 300 may be integral, or may be separately formed and connected together by known methods. In one embodiment, the connector shield 300 may be integrally formed of an elastic material, for example, by injection molding a material having proper sealing property, environmental defending capability and stability such as silicone rubber, thermoplastic elastomer, and the like.

The assembling process of the bayonet-type bundled RF connector assembly 10 will be described below. First, the assembling process of the male connector 100 will be described. With reference to FIGS. 3 and 4, the elastic member 150 is sleeved on the cylinder 111 of the male connector body 110 from far to near and abuts against the outer flange 113 of the male connector body 110. The O-ring 134 is mounted into the interior of the sleeve 130 from far to near and abuts against the inner flange 132 of the sleeve 130. Thereafter, the male connector body 110 with the elastic member 150 is inserted into the sleeve 130 with the O-ring 134 from far to near, until the outer flange 113 of the male connector body 110 abuts against the inner flange 132 of the sleeve 130. At this time, the O-ring 134 is sandwiched between the proximal surface of the outer flange 113 and the distal surface of the inner flange 132. The unit male connector 120 with the cable 140 is inserted into the through hole 112 of the male connector body 110 for press fitting, thereby completing the assembling of the male connector 100.

Referring to FIGS. 7 and 8, the unit female connector 220 with the cable 240 is inserted into the through hole 212 of the female connector body 210 for press fitting, thereby completing the assembling of the female connector 200.

Thereafter, the marker on the sleeve 130 of the male connector 100 is aligned with the marker on the female connector body 210 of the female connector 200, and the pin 133 of the sleeve 130 of the male connector 100 is screwed into the spiral slot 215 of the proximal barrel portion 213 of the female connector body 210, until the elastic member 150 is compressed against the outer flange 113 of the male connector body 110, as shown in FIG. 1. Thereby, the assembling of the bayonet-type bundled RF connector assembly 10 is completed.

The bayonet-type bundled RF connector assembly 10 according to the embodiments of the present invention uses a bayonet-type connection. The rotation travels only 60 degrees during the installation, i.e. the connection of the male connector and the female connector is completed by rotating one-third turn.

The bayonet-type bundled RF connector assembly 10 according to the embodiments of the present invention is provided with an elastic member 150 and an elastic member 127 for preventing loosening during vibration. Specifically, the elastic member 150 prevents loosening in the mechanical connection between the male connector 100 and the female connector 200, and the elastic member 127 prevents loosening in the mechanical connection and the electrical connection between the unit male connector 120 and the unit female connector 220. Thereby, the cable 140 of the male connector 100 and the cable 240 of the female connector 200 always remain in continuous and stable electrical contact to achieve a favorable PIM performance.

The bayonet-type bundled RF connector assembly 10 according to the embodiments of the present invention is provided with an O-ring 134 located between the male connector 100 and the female connector 200, a cable shield 128 at an end of the cable 140, and a connector shield 300 enclosed outside the male connector 100 and the female connector 200, thereby enabling achieving favorable waterproofing properties (for example, IP67/68 waterproofing). In addition, the connector shield 300 can also protect the male connector 100 and the female connector 200 from damage by the external environment.

The male connector body 110 of the male connector 100 and the female connector body 210 of the female connector 200 of the bayonet-type bundled RF connector assembly 10 according to the embodiments of the present invention may be integral pieces formed by metal forging or by plastic (PA46/66, PBT) injection molding, thereby saving the manufacturing cost.

The bayonet-type bundled RF connector assembly 10 according to the embodiments of the present invention is provided with a "fool-proof mechanism," which ensures that the plurality of cables between the male connector 100 and the female connector 200 are connected one by one in a predetermined solution.

Although the exemplary embodiments of the present disclosure have been described, a person skilled in the art should understand that, he or she can make multiple changes and modifications to the exemplary embodiments of the present disclosure without substantively departing from the spirit and scope of the present disclosure. Accordingly, all the changes and modifications are encompassed within the protection scope of the present disclosure as defined by the claims. The present disclosure is defined by the appended claims, and the equivalents of these claims are also contained therein.

What is claimed is:

1. A bayonet-type bundled RF connector assembly, characterized in that the connector assembly comprises:

a male connector including a male connector body and a sleeve sleeved on the male connector body, wherein a first elastic member is provided in a gap between the male connector body and the sleeve, and the male connector body is provided with a plurality of first through holes;

a plurality of unit male connectors for connecting a plurality of male connector cables, each unit male connector mounted in a respective first through hole;

a plurality of second elastic members, each surrounding a respective one of the plurality of unit male connectors; and a female connector mated with the male connector, wherein the female connector includes a female connector body provided with a plurality of second through holes; and a plurality of unit female connectors for connecting a plurality of female connector cables, each of the unit female connectors mounted in a respective second through hole;

wherein the sleeve of the male connector is connected to the female connector body of the female connector by a bayonet connection of a pin and a slot, and the first elastic member secures engagement between the pin and the slot, and each of the plurality of unit male connectors is urged into contact with a respective one of the plurality of unit female connectors by a second elastic member.

2. The bayonet-type bundled RF connector assembly according to claim 1, characterized in that the male connector body includes a cylinder, and an outer flange that surrounds and projects radially outward from a sidewall of the cylinder.

3. The bayonet-type bundled RF connector assembly according to claim 2, characterized in that the sleeve includes a barrel, and an inner flange projecting radially inward from a proximal end surface of the barrel, wherein the inner flange abuts against the outer flange of the male connector body to secure the sleeve in place on the male connector body.

4. The bayonet-type bundled RF connector assembly according to claim 2, characterized in that the female connector body includes an intermediate wall portion, a proximal barrel portion projecting proximally from the intermediate wall portion, and a distal barrel portion projecting distally from the intermediate wall portion.

5. The bayonet-type bundled RF connector assembly according to claim 4, characterized in that the first elastic member is disposed on the cylinder of the male connector body between the proximal barrel portion of the female connector body and the outer flange of the male connector body.

6. The bayonet-type bundled RF connector assembly according to claim 5, characterized in that the first elastic member is a C-ring, a coil spring or any other element made from an elastic material.

7. The bayonet-type bundled RF connector assembly according to claim 1, characterized in that the unit male connector includes an outer contact connecting an outer conductor of a male connector cable, and a cable sleeve located radially outside the outer contact and fixed to an outer sheath of the male connector cable, the outer contact is provided with an outer flange at a portion exposed of the cable sleeve, and the second elastic member is disposed between the outer flange of the outer contact and an end of the cable sleeve.

8. The bayonet-type bundled RF connector assembly according to claim 7, characterized in that the unit female connector includes an outer contact for connecting the outer conductor of the female connector cable inside which a step portion is provided, and the outer contact of the unit male connector is insertable into the outer contact of the unit female connector and a distal end surface of the unit male connector is kept in contact with the step portion under an action of the second elastic member.

9. The bayonet-type bundled RF connector assembly according to claim 7, characterized in that the second elastic member is a C-ring, a coil spring or any other element made from an elastic material.

10. The bayonet-type bundled RF connector assembly according to claim 3, characterized in that an O-ring is provided between the inner flange of the sleeve and the outer flange of the male connector body.

11. The bayonet-type bundled RF connector assembly according to claim 1, characterized in that distal end portions of the plurality of male connector cables are connected to the plurality of respective unit male connectors, and a cable shield seals the plurality of male connector cables immediately adjacent to a proximal side of the male connector bodies.

12. The bayonet-type bundled RF connector assembly according to claim 1, characterized in that the connector assembly further includes a connector shield configured to enclose the assembled male and female connectors.

13. The bayonet-type bundled RF connector assembly according to claim 12, characterized in that the connector shield includes a proximal barrel portion having a smaller diameter, a distal barrel portion having a larger diameter and a shoulder that connects the proximal barrel portion and the distal barrel portion together.

14. The bayonet-type bundled RF connector assembly according to claim 1, characterized in that the unit male connector is securable to a first through hole of the male connector by press fitting, welding or threaded engagement.

15. The bayonet-type bundled RF connector assembly according to claim 1, characterized in that the unit female connector is securable to a second through hole of the female connector by press fitting, welding or threaded engagement.

16. The bayonet-type bundled RF connector assembly according to claim 1, characterized in that the sleeve of the male connector and the female connector body of the female connector are provided with multiple pins and multiple spiral slots that are mated with each other.

17. The bayonet-type bundled RF connector assembly according to claim 1, characterized in that the bundled RF connector assembly is provided with a fool-proof mechanism in which a plurality of male connector cables and a plurality of female connector cables are connected one by one according to a predetermined solution.

18. The bayonet-type bundled RF connector assembly according to claim 17, characterized in that the fool-proof mechanism includes a plurality of bumps and a plurality of respective grooves, wherein the plurality of bumps and the plurality of grooves are circumferentially unevenly disposed on the sleeve of the male connector and the female connector body of the female connector respectively or circumferentially unevenly disposed on the female connector body of the female connector and the sleeve of the male connector respectively, and the circumferential positions of the plurality of bumps and the plurality of grooves are aligned one by one.

19. The bayonet-type bundled RF connector assembly according to claim 1, characterized in that the male connector body and the female connector body are integral pieces formed by metal forging or by plastic injection molding.

20. The bayonet-type bundled RF connector assembly according to claim 1, wherein at least a portion of the slot defines a portion of a spiral.

* * * * *